US006484967B2

(12) United States Patent
Protte

(10) Patent No.: US 6,484,967 B2
(45) Date of Patent: Nov. 26, 2002

(54) DRIVE UNIT FOR A MODEL HELICOPTER

(76) Inventor: Christoph Protte, Johann-Wegener Str. 17b, 33129 Delbrück (DE)

( * ) Notice: Subject to any disclaimer, the term of this patent is extended or adjusted under 35 U.S.C. 154(b) by 25 days.

(21) Appl. No.: 09/860,527

(22) Filed: May 21, 2001

(65) Prior Publication Data

US 2002/0017591 A1 Feb. 14, 2002

(30) Foreign Application Priority Data

May 31, 2000 (DE) ..... 100 27 081

(51) Int. Cl.[7] ..... B64C 27/12
(52) U.S. Cl. ..... 244/60; 244/17.11; 446/37
(58) Field of Search ..... 244/17.11, 53 R, 244/60, 54; 446/37; 416/170 R

(56) References Cited

U.S. PATENT DOCUMENTS 4,222,280 A * 9/1980 Stewart ..... 244/54
4,272,041 A * 6/1981 Mabuchi et al. ..... 244/17.21
4,829,850 A * 5/1989 Soloy ..... 74/665 B
5,782,079 A * 7/1998 Chiang et al. ..... 60/39.36

* cited by examiner

*Primary Examiner*—Galen L. Barefoot
(74) *Attorney, Agent, or Firm*—Shinjyu Global IP Counselors, LLP

(57) ABSTRACT

The present invention relates to a drive unit for a model helicopter comprising a fuselage in the central portion of which both the drive unit and a rotor shaft 1 are supported, characterized in that the drive unit comprises a horizontally arranged turbine 2 having a turbine shaft 3 which is extended in the inlet portion of the turbine 2 and connected to a transmission 4.

12 Claims, 5 Drawing Sheets

DRIVE UNIT FOR A MODEL HELICOPTER

DESCRIPTION

The present invention relates to a drive unit for a model helicopter according to the preamble of the main claim.

In detail, the invention relates to a drive unit for a model helicopter comprising a fuselage the central portion of which has formed thereon bearing points for the detachable attachment of a carrier for supporting a rotor shaft, a transmission and a drive.

Very different designs of drive units for model helicopters are known from model construction. These normally comprise model engines based on the two-stroke combustion principle, as are also used in fixed-wing airplane models.

It is desired in model-making and, in particular, in airplane and helicopter model construction, that the models are as realistic as possible not only optically but also with respect to their operability. That is why it has always been found to be a disadvantage when internal combustion engines of a standard construction are installed in helicopter models. Piston engines produce a very typical sound which differs from that of the original examples operated with turbines. In addition, the exhaust generation in two-stroke engines is not realistic. This is also true for airplane models of jet engine airplanes which have the additional flaw that propellers must be provided that impair their appearance quite considerably.

That is why attempts have recently been made to build miniature turbines which both in their form and their noise generation and also with respect to their exhaust characteristics correspond to original turbines and jet engines, respectively. The installation of such miniature turbines in fixed-wing airplanes does not present any problems because the original examples can be followed.

By contrast, it is not possible to install miniature turbines in helicopter models of a standard size because both the installation position and transmission arrangements cannot be exactly copied on a reduced scale. In addition, it is difficult to imitate adequate air intake openings and exhaust openings of the original design because the model turbines, based on the scale of such helicopters, are not small enough.

On the other hand it has so far not been possible to provide transmission assemblies suited for a model drive.

It is the object of the present invention to provide a drive unit for a model helicopter of the above-mentioned type which, using a turbine and being of a simple construction and reliable operability, can be used in a model helicopter.

According to the invention this object is achieved by the features of the main claim; the subclaims show further advantages arising from the design of the invention.

The drive unit according to the invention is characterized by a number of considerable advantages.

Thanks to the horizontal arrangement of the turbine it is possible on the one hand to adapt the direction of flow of the turbine of the model helicopter to the original examples of helicopters and, in particular, to design the fuselage true to scale. This applies, in particular, to the inlet portion and the air supply to the turbine.

Thanks to the extended design of the turbine shaft in the inlet portion it is possible in a particularly easy manner to support the turbine in an operationally safe manner and to transmit the output power to the transmission. At the same time the air inflow to the turbine effects an efficient cooling of the transmission.

It is of particular advantage that the turbine shaft is supported on a carrier which carries the transmission. As a result, a safe assignment between turbine and transmission is ensured.

The turbine shaft is preferably supported on the carrier by means of a pre-loaded bearing. Advantageously, the bearing is mounted on the free end portion of the turbine shaft so that the transmission can be flanged to the area of the turbine shaft positioned behind the bearing. This measure enhances the overall stability of the arrangement.

Both for reasons of an optimum center-of-gravity position and for diverting the exhaust gases in an advantageous manner, it is intended that the turbine is installed in the direction of flow behind the rotor shaft.

According to the invention the transmission is preferably of a three-stage configuration; it can be designed as a belt transmission, as a toothed gearing or as a friction gear.

Preferably, the transmission has a gear reduction of 100,000 rpm to 1,200 to 1,800 rpm.

A clutch is preferably arranged between the transmission and the rotor shaft so as to separate the transmission and the rotor, in particular in case of transmission or turbine failures. In such a case the model helicopter can land safely by autorotation of the rotor.

It is particularly advantageous when the turbine is provided with a speed limiter. The limiter may e.g. comprise a control means for a fuel pump.

The invention shall now be described with reference to an embodiment taken in conjunction with the drawing, in which.

In the figures the fuselage of the model helicopter is not shown in detail because this member can be designed in very different ways and is also known from the prior art. The model helicopter comprises a main rotor and a tail rotor.

Figure 1:
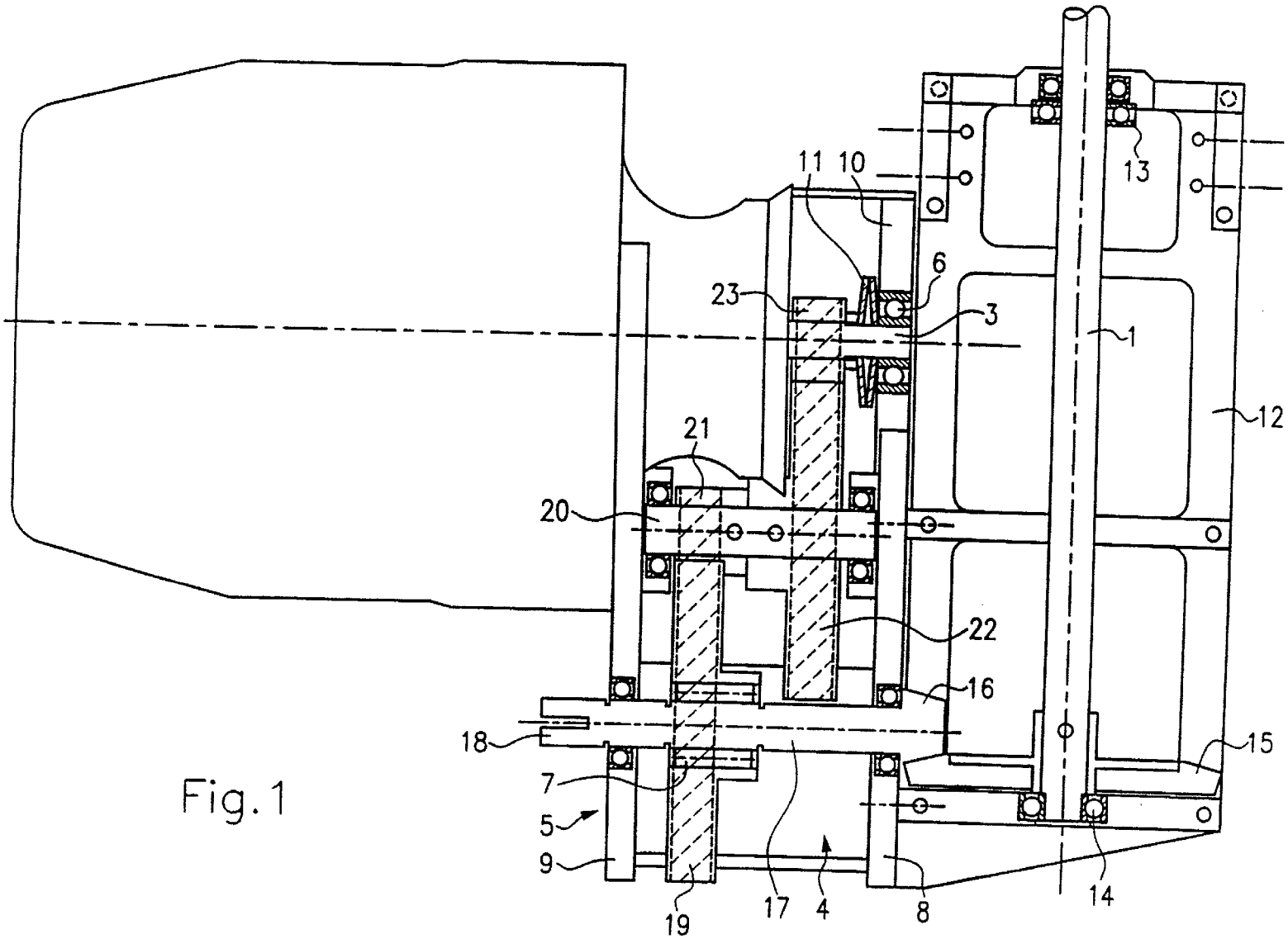
FIG. 1 is a schematic partial side view of the drive unit according to the invention.
Figure 2:
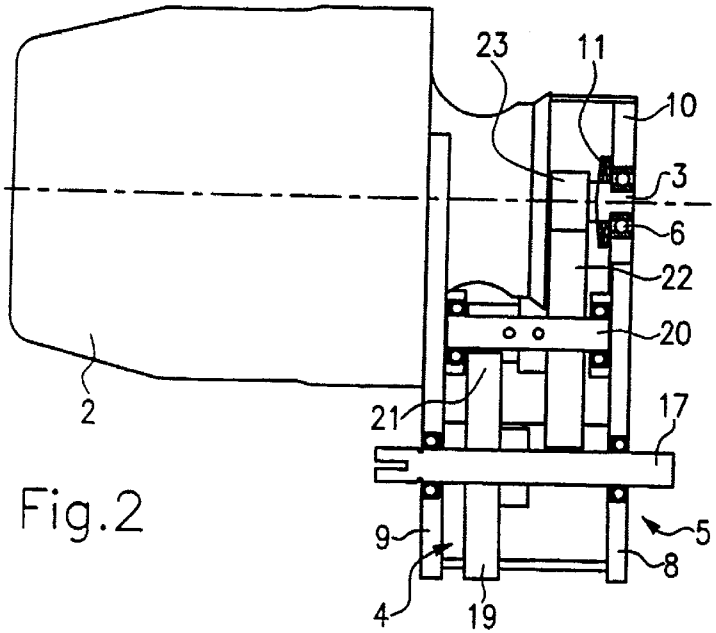
FIG. 2 is a simplified partial side view, by analogy with the illustration of FIG. 1.

As becomes apparent from FIGS. 1 and 2, a turbine 2 is horizontally arranged in the direction of flow—and thus also in flight direction—behind a vertically supported rotor shaft 1. A turbine shaft 3 of the turbine 2 is extended forwards in the direction of flow and supported by means of a bearing 6 on a carrier 5.

The carrier 5 comprises both the bearing of a transmission 4 and the rotor shaft 1.

In detail, the turbine shaft 3 is supported on a yoke plate 10 by means of bearing 6. Bearing 6 may be designed as a separable ball bearing; it is pre-loaded by means of a spring package 11. The spring package 11 comprises disk springs.

The yoke plate 10 is connected to a front carrier plate 8 which forms part of the carrier 5. A rear carrier plate 9 serves the further mounting of the turbine 2.

As becomes also apparent from the figure, a bearing cage 12 is provided and has mounted thereon the rotor shaft 1 by means of bearings 13 and 14. At its lower end the rotor shaft 1 carries a bevel gear 15 which may be designed as a toothed wheel or as a frictional wheel. Said bevel gear 15 meshes with a further bevel gear 16 which is supported between the front and rear carrier plates 8, 9 and provided with an output 18 for the tail rotor.

Figure 3:
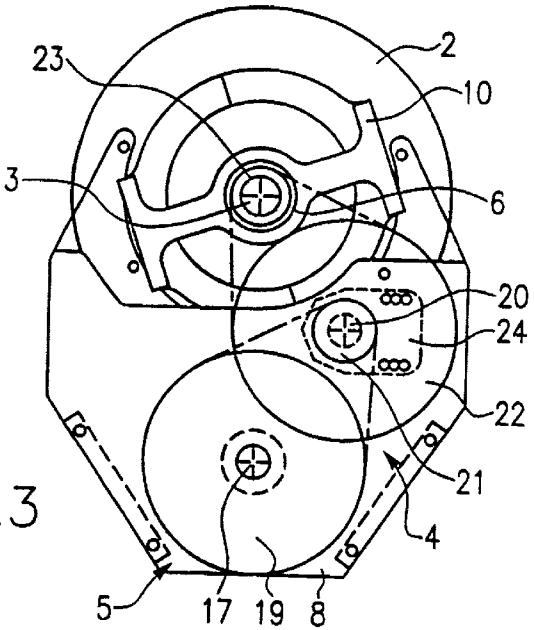
FIG. 3 is a front view of the arrangement shown in FIG. 2, with illustration of the transmission.

A clutch 7 which is designed as a freewheel clutch is seated on the auxiliary shaft 17. The clutch, in turn, communicates with a wheel 19 which forms part of a second transmission stage. To this end a wheel 21 is supported on an intermediate shaft 20 which, in turn, is supported by the two carrier plates 8, 9. A further wheel 22 which is fastened to the intermediate shaft 20 forms part of a first transmission stage whose associated wheel 23 is seated on the turbine shaft 3. It goes without saying that the wheels 19, 21, 22, 23 may be designed as toothed wheels or as frictional wheels. In the present embodiment a belt transmission is provided, as becomes apparent from the illustration in FIG. 3. FIG. 3 shows in particular that the intermediate shaft 20 is supported on a slide 23 which is displaceable relative to the carrier 5, in particular towards the front carrier plate 8. It is thereby possible to adjust the belt tension accordingly.

Figure 5:
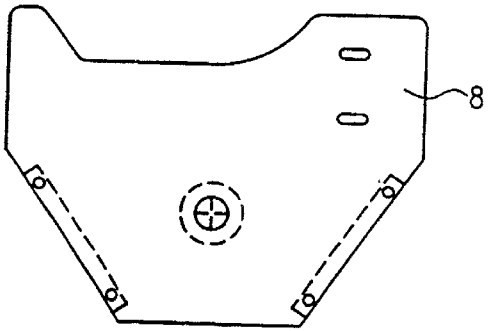
FIG. 5 is a view of a front carrier plate of the carrier.
Figure 4:
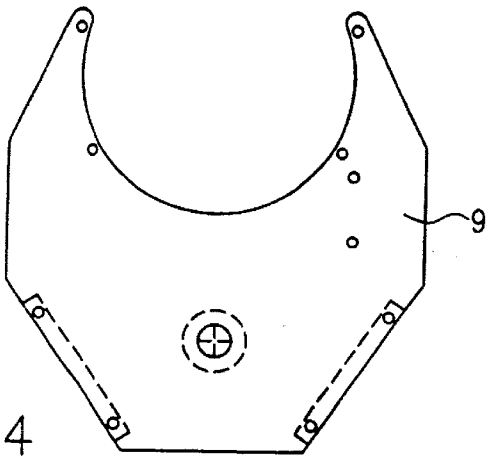
FIG. 4 is a view of a rear carrier plate of the carrier.

Each of FIGS. 4 and 5 shows the carrier plates 8 and 9, respectively.

It goes without saying that the carrier 5 is designed on the whole in such a way that it can be fastened to coupling points of the fuselage in the customary way, so that the drive unit can easily be removed from the model helicopter as a whole unit.

The clutch 7 is designed such that upon damage or standstill of the turbine and the transmission the tail rotor is still firmly connected to the main rotor so that a safe landing of the model helicopter is possible by autorotation.

The two bevel gears 15 and 16 form a transmission with i=1:4, so that the tail rotor can be driven at 7,200 rpm when the rotor shaft 1 rotates at 1,800 rpm. This example is based on a turbine speed of 100,000 rpm.

The illustration of a fuel pump and of additional units has been omitted in the embodiment.

According to the invention it is further possible in an especially easy way to start the drive unit by means of an electric motor flanged thereto.

Figure 6:
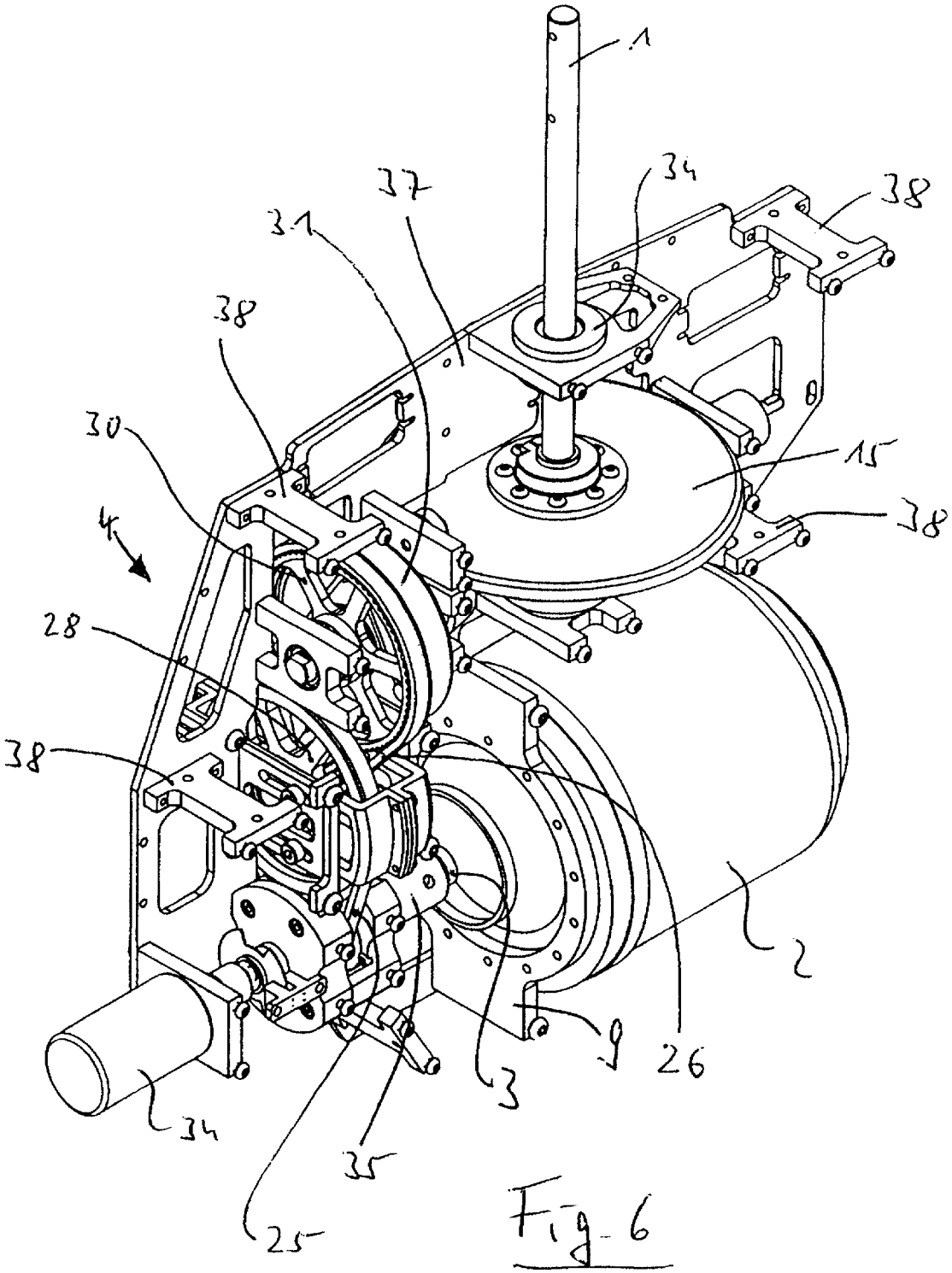
FIG. 6 is a perspective view, partly in a disassembled state, of an embodiment of the drive unit according to the invention.
Figure 7:
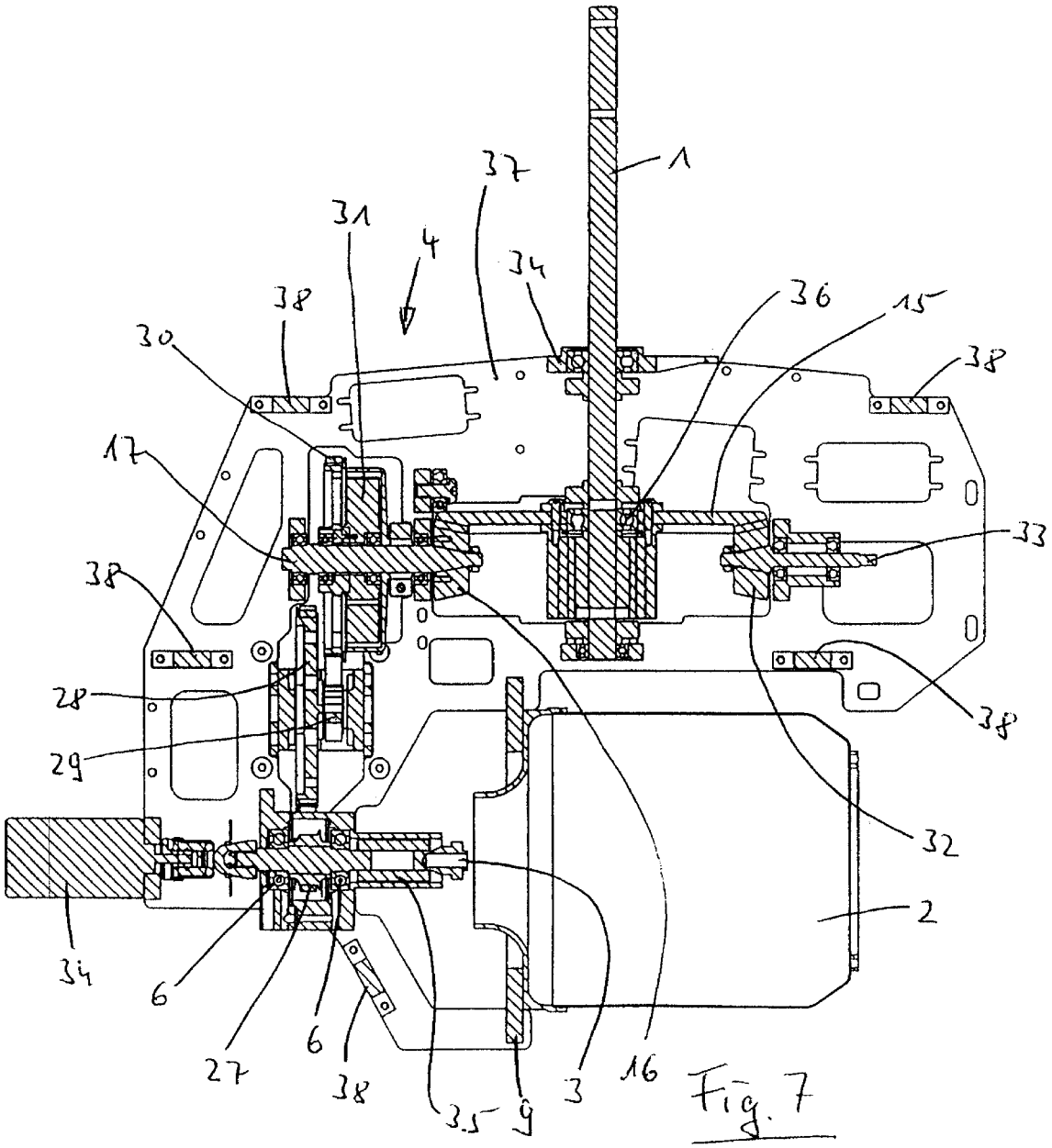
FIG. 7 is a side view, partly in section, of the drive unit shown in FIG. 6.
Figure 8:
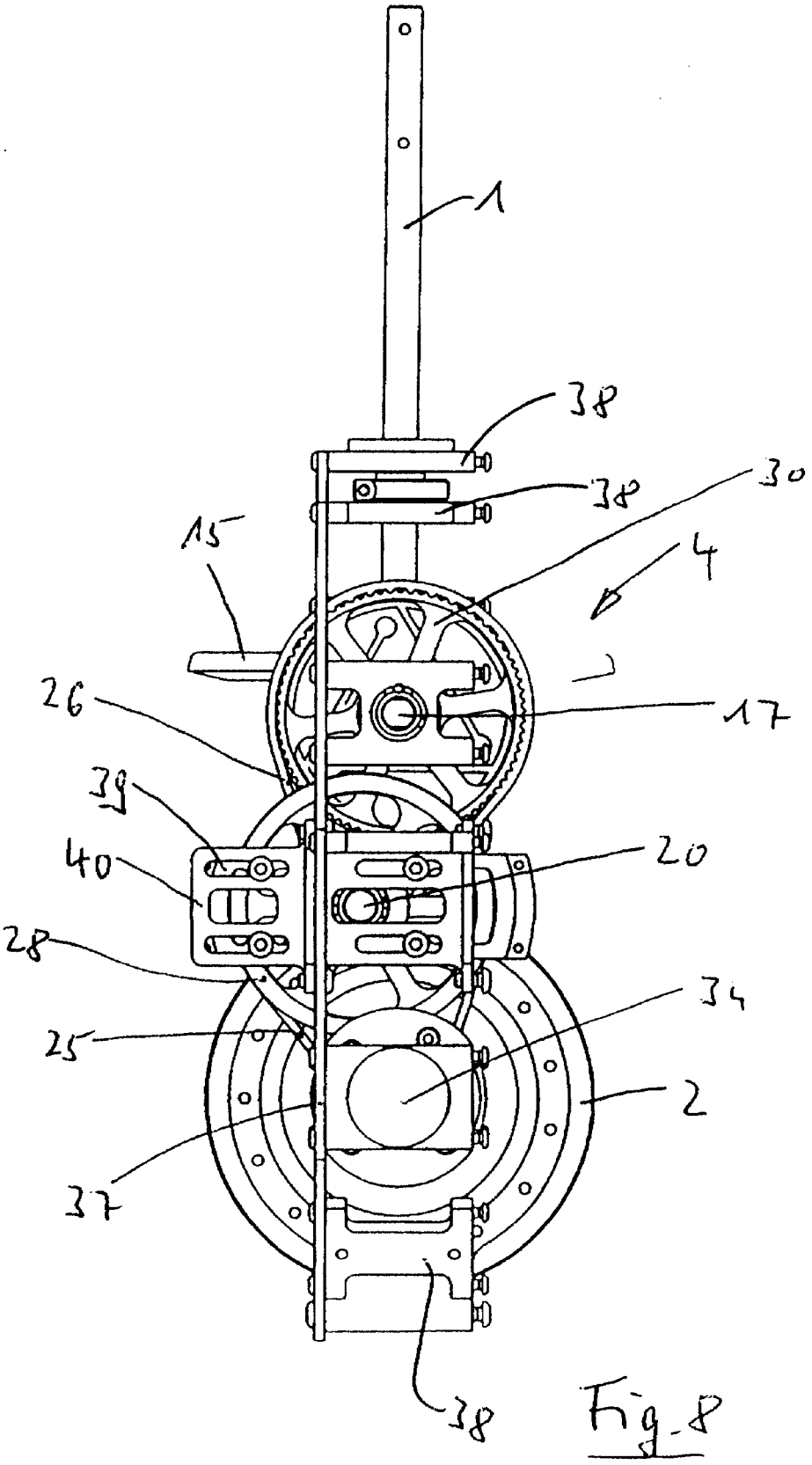
FIG. 8 is a front view of the drive unit shown in FIGS. 6 and 7.

FIGS. 6 to 8 show a further embodiment of the drive unit according to the invention. Like members are provided with like reference numerals as in the preceding figures.

In the embodiment of FIGS. 6 to 8 the transmission is designed as a belt drive. Two transmission stages are provided, namely a transmission stage with a first toothed belt 25 and a second stage with a second toothed belt 26. The toothed belt 25 of the first stage is running over toothed wheels 27; 28 whereas the toothed belt 26 of the second stage is running over toothed wheels 29; 30.

The third transmission stage is formed by the bevel gears 15; 16; the bevel gear 15 is here arranged coaxial to the rotor shaft 1 whereas bevel gear 16 is seated on an auxiliary shaft 17. The auxiliary shaft 17 is connected to a centrifugal clutch 31 which, in turn, is releasably connected to the wheel 30.

The bevel gear drive (third transmission stage) which is formed by bevel gears 15; 16 may be designed and arranged in a different way. The rotational direction of a further bevel gear 32 which is seated on a tail rotor shaft 33 can thereby be changed. It is thus possible to change the rotations of the main rotor and the tail rotor.

The turbine rotates e.g. at a speed of 85000 $min^{-1}$; the tail rotor shaft has a rotational speed of 5886 $min^{-1}$, whereas the main. rotor shaft rotates at 1260 $min^{-1}$. It goes without saying that the indicated speeds are approximative speeds indicated by way of example. Hence, on the whole there is a total gear ratio of the transmission of i=67.29. The first stage has a gear ratio of 3.8:1 while the second stage has a gear ratio of 3.8:1. As for the third stage formed by the bevel gear 15, the gear ratio is 4.66:1.

As follows from the illustrations, the rotor shaft 1 is supported by an independent dome plate 34 with a corresponding bearing.

Furthermore, as becomes apparent from the illustrations, the turbine shaft 3 is connected to the toothed belt disk (wheel 27) directly, i.e. without a pre-loaded bearing, and is thus directly flanged to the transmission.

An electric starter 34 which is firmly connected to the drive unit according to the invention may be provided for starting the turbine.

Reference numeral 35 designates a shaft coupling which serves the connection between turbine shaft 3 and transmission. Furthermore, a freewheel 36 is provided on rotor shaft 1.

Furthermore, as follows from the illustrations of FIGS. 6 to 8, a total of two side plates 37 are provided; one of the two side plates 37 has been removed for the purpose of a clear illustration. The two side plates 37 are connected via support struts 38 which permit additional functions, such as the fastening of bearings, or the like. As becomes in particular apparent from FIG. 8, a slide 39 is provided for tensioning the belt drives and has the intermediate shaft 21 supported thereon. The toothed belts 25; 26 can be tensioned by laterally displacing the slide 39. For this purpose the slide 39 comprises elongated holes in which screws are guided that can be clamped against a transverse carrier 40.

Further constructional details become apparent from FIGS. 6 to 8.

The present invention is not limited to the illustrated embodiments; rather many alterations and modifications are possible within the scope of the present invention.

What is claimed is:

1. A drive unit for a model helicopter comprising a fuselage and a carrier (5) which can be installed into said fuselage and supports a rotor shaft (1), a transmission (4) and a drive unit, characterized in that said drive unit includes a horizontally arranged turbine (2) whose turbine shaft (3) is extended in the inlet portion of said turbine (2) and connected to said transmission (4) including belt drives.

2. The drive unit according to claim 1, characterized in that said turbine shaft (3) is supported on said carrier (5) which carries said transmission (4).

3. The drive unit according to claim 2, characterized in that said turbine shaft (3) is supported by means of a pre-loaded bearing (6) on said carrier (5).

4. The drive unit according to any one of claims 1 to 3, characterized in that said transmission (4) is arranged in the direction of flow in front of said turbine (2).

5. The drive unit according to any one of claims 1 to 4, characterized in that said turbine (2) is installed in the direction of flow behind said rotor shaft (1).

6. The drive unit according to any one of claims 1 to 5, characterized in that said transmission (4) is of a three-stage configuration.

7. The drive unit according to any one of claims 1 to 6, characterized in that said transmission (4) has a gear reduction from 100,000 rpm to 1,200 to 1,800 rpm.

8. The drive unit according to any one of claims 1 to 7, characterized in that a clutch (7) is arranged between said transmission (4) and said rotor shaft (1).

9. The drive unit according to claim 8, characterized in that said clutch (7) is designed as a centrifugal clutch.

10. The drive unit according to claim 9, characterized in that said clutch (7) is designed as a freewheel clutch for the autorotation of said rotor.

11. The drive unit according to any one of claims 1 to 10, characterized in that said turbine (2) is provided with a speed limiter.

12. The drive unit according to claim 11, characterized in that said speed limiter comprises a control means for a fuel pump.

* * * * *